United States Patent [19]

Gueret

[11] Patent Number: 4,982,882

[45] Date of Patent: Jan. 8, 1991

[54] CAP FOR DISPENSING A FLUID OR VISCOUS PRODUCT, AND CONTAINER EQUIPPED WITH SUCH A CAP

[75] Inventor: Jean-Louis Gueret, Paris, France

[73] Assignee: L'Oreal (A Joint Stock Company constituted under French Law), Paris, France

[21] Appl. No.: 288,878

[22] Filed: Dec. 23, 1988

[30] Foreign Application Priority Data

Dec. 24, 1987 [FR] France ..... 8718152

[51] Int. Cl.[5] ..... B65D 3/00

[52] U.S. Cl. ..... 222/531; 222/534; 220/254; 220/281; 220/337

[58] Field of Search ..... 220/253, 254, 255, 281, 220/337, 347; 222/531, 532, 533, 534

[56] References Cited

U.S. PATENT DOCUMENTS

| | | | |
|---|---|---|---|
| 2,447,870 | 8/1948 | Polcyn | 220/254 X |
| 3,255,930 | 6/1966 | Woodard | 222/534 X |
| 3,303,971 | 2/1967 | Stevens, Jr. | 222/534 X |
| 3,529,754 | 9/1970 | Yochim | 222/531 |
| 3,874,568 | 4/1975 | LaVange et al. | 222/505 |
| 4,165,014 | 8/1979 | Ruscitti | 220/281 X |
| 4,170,315 | 10/1979 | Dubach et al. | 220/281 |
| 4,209,100 | 6/1980 | Uhlig | 220/281 X |
| 4,487,342 | 12/1984 | Shy | 222/534 X |
| 4,711,363 | 12/1987 | Marino | 220/254 X |
| 4,776,501 | 10/1988 | Ostrowsky | 222/534 X |
| 4,804,113 | 2/1989 | Ciaccio | 220/254 X |
| 4,807,786 | 2/1989 | Gueret | 222/499 |

FOREIGN PATENT DOCUMENTS

| | | |
|---|---|---|
| 0199673 | 9/1986 | European Pat. Off. . |
| 2156011 | 11/1971 | Fed. Rep. of Germany . |
| 8707552 | 5/1987 | Fed. Rep. of Germany . |
| 2233248 | 6/1974 | France . |
| 528417 | 11/1972 | Switzerland . |
| 2194223 | 7/1987 | United Kingdom . |

*Primary Examiner*—Stephen Marcus
*Assistant Examiner*—Nova Stucker
*Attorney, Agent, or Firm*—Cushman, Darby & Cushman

[57] ABSTRACT

The cap (1), intended to be mounted on the neck of a container containing the product, includes a short tube (5) arranged to cooperate with the neck. The short tube (5) is closed by a horizontal top (7) provided with a nozzle (8) projecting from the side opposite the short tube and communicating with it; a lid mounted to pivot about an axis (10) substantially orthogonal to that of the short tube (5) closes the tube and is arranged to close the nozzle (8) for a closed position, while passageway includes a conduit (21) provided in the lid (9) and discharging to outside the lid; the conduit (21) communicates with the short tube (5). Opening member includes a pushbutton (24) arranged to cause the lid (9) to pivot about its axis (10) from the closed position to an open position.

9 Claims, 3 Drawing Sheets

CAP FOR DISPENSING A FLUID OR VISCOUS PRODUCT, AND CONTAINER EQUIPPED WITH SUCH A CAP

FIELD OF THE INVENTION

The invention relates to a cap for dispensing a fluid or viscous product, intended to be mounted on the neck of a container containing the product. Such a cap includes a short tube arranged to cooperate with the neck, means for closing and opening this short tube, and passageway means for dispensing the product to outside the container.

BACKGROUND OF THE INVENTION

German Patent 21 56 011 has already described a cap for dispensing a fluid or viscous product, intended for being mounted on the neck of a container containing the product. The cap includes a short tube that comes to be fixed on the neck and is closed by a horizontal top associated with a nozzle projecting from the side opposite the short tube, and the nozzle communicates with the interior of the container, and the cap also includes passageway means for dispensing the product to the outside and means for closing and opening the passageway means. The opening means includes a lid in the form of a small plate, mounted pivotably about an axis substantially orthogonal to that of the short tube, the lid being arranged to close the nozzle for a closed position, and the passageway means include a conduit which is provided in the lid and discharges to outside the lid and communicates with the nozzle.

OBJECT AND SUMMARY OF THE INVENTION

The object of the invention is to propose a dispenser cap of the type defined above that is of simple, sturdy and economical construction and which can be opened easily, particularly while holding the container in only one hand.

The object of the invention is attained, for a cap of the type defined above, by providing that the opening means include a pushbutton arranged to cause the lid to pivot about its axis from the closed position to an open position.

In a first variant, the nozzle is disposed on the horizontal top of the short tube. In a second variant, the nozzle is disposed on the neck of the container and extends through the horizontal top associated with the short tube, the nozzle in this case comprising a separate part of the cap, while in the first variant it is in one piece with the cap. Advantageously, the lid is provided with a sleeve tube arranged to come to cover the nozzle; the conduit of the lid discharges in the sleeve tube, and the nozzle remains engaged in the sleeve tube when the lid is in the open position. When the nozzle is made in a single piece with the cap, it may advantageously be provided that the nozzle and the horizontal top are substantially rigid, with the inside diameter of the sleeve tube being greater than the outside diameter of the nozzle to provide play that permitting the deflection of the lid between an open position and its closed position. In another embodiment, it may also be provided that the nozzle is at least partially deformable and slides in the sleeve tube in the course of the deflection of the lid between an open position and its closed position; in such a case, if the nozzle and the cap comprise a single piece, it may be provided that the nozzle is connected to the horizontal top of the short tube by a deformable zone. It may also be advantageous, especially if the nozzle is at least partially deformable, for this nozzle to have an annular bead on the outside in the vicinity of its free end, and for the sleeve tube to have an annular bead inside in the vicinity of its free end, so that the cooperation of the bead of one of these elements with the wall of the other assures sliding guidance, while the cooperation of the two beads with one another avoids disengagement of the nozzle from the sleeve tube.

The surface of the cap preferably has the shape of a prismatic or cylindrical surface with generatrices parallel to a fixed direction; the section of the cap along a plane orthogonal to the generatrices advantageously has a substantially rectangular or oval shape, corresponding to that of the container intended to receive the cap. The short tube has an axis substantially parallel to the generatrices of the surface of the cap, while the horizontal pivot axis of the lid is orthogonal to the axis of the short tube, and the pushbutton is provided in the wall of the cap in such a manner as to cooperate with at least one ramp disposed on an extension integral with the lid and the mean direction of which is substantially orthogonal to the plane of this lid.

In the closed position, the lid advantageously comes to enter the inside of the contour of the envelope of the cap, the end of the conduit provided in the lid discharging horizontally to the outside and being closed by the inside surface of the wall of the cap when the lid is in the closed position. Preferably, the lid includes an extension on each side that is provided with a ramp, each extension being received in a seat provided in the cap; the pushbutton, intended for cooperating with the ramps to cause the opening of the cap, is capable of engaging this seat.

The pushbutton is advantageously formed by a tongue, or tab, with its base contiguous with the wall of the cap and its other sides being free; the flexibility of the material at the base assures the pivoting of the tongue, the end of which opposite the base is intended to cooperate with the ramp. The pivoting of the lid is advantageously assured by a film hinge. This pivoting can be provided on the edge of a portion locked on the top of the cap, this portion itself being pivoted, preferably by a film hinge, at the edge of the cap. The cap may thus be molded from plastic material in a single piece, and the nozzle may optionally be molded separately.

The invention also relates to a container equipped with a cap such as that defined above.

Based on the provisions described above, the invention comprises a certain number of other provisions as well, which will be described in greater detail below in conjunction with the accompanying drawings in terms of three exemplary embodiments, which it will be understood are in no way limiting.

DESCRIPTION OF THE PREFERRED EMBODIMENTS

Figure 1:
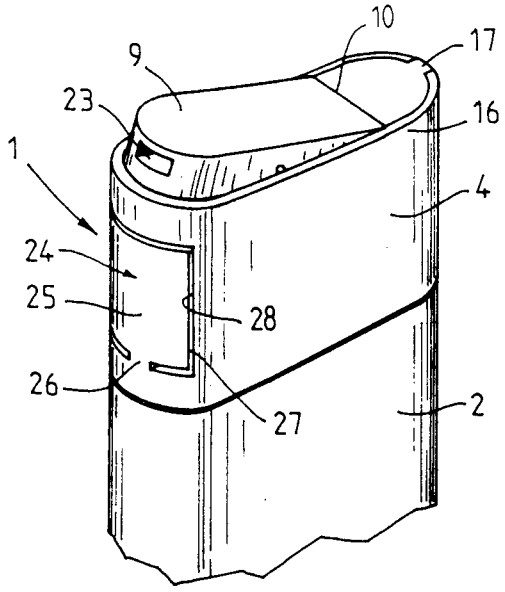
FIG. 1 is a perspective view of a cap according to the invention mounted on a container, shown in the open position.

Turning now to FIGS. 1-6, a dispenser cap 1 for a fluid or viscous product contained in a container 2 can be seen. The cap has the same shape as the container, of which it comprises a kind of extension; in the example in question, the cap has a cylindrical shape, and the section orthogonal to the direction of the generatrices has a substantially rectangular shape, the short sides of which are replaced by semicircles; the container has the same orthogonal section. Accordingly, the cap and the container have two long plane parallel sides and two short convex sides toward the outside.

The cap 1 is intended to be mounted on the neck 3 (see FIG. 4) of the container. The cap includes a short tube 5, located inside the outer envelope 4 of the cap, the short tube being arranged to engage the neck 3 in a sealed manner. At a certain radial distance, the short tube 5 is surrounded by a skirt 6, generally of a cylindrical shape generated by revolution, capable of covering the outside of the neck 3.

The short tube 5, which is generally of cylindrical shape generated by revolution and which has the same axis as the envelope 4 of the cap, is closed by a horizontal top 7 that is orthogonal to the direction of the generatrices of the short tube 5. This top 7 is provided on the side opposite the short tube 5 with a nozzle 8, which through the top 7 communicates with the short tube. The outer diameter of the nozzle 8 is markedly less than that of the short tube 5.

Means for closing the short tube 5 are provided and include a lid 9 mounted to pivot about an axis 10 that is substantially orthogonal to that of the tube 5. In the folded-down closed position shown in FIG. 4, the lid 9 is arranged to close the nozzle 8. This lid 9 includes a sleeve tube 11, the axis of which is orthogonal to the lid, on its inside face; the sleeve tube is capable of coming to cover the nozzle 8, as shown in FIG. 4.

Advantageously, the lid 9 is pivoted on the edge of a portion 12 which on its inside face is provided with a hook or barb 13, orthogonal to the portion 12, and arranged to be locked in a hole 14 provided on an upper horizontal wall 15 of the cap 1. When the barb 13 is engaged in the hole 14, as shown in FIG. 4, the portion 12 is fixed on the wall 15, this portion 12 entering inside an extension 16 of the cylindrical envelope 4 of the cap. The portion 12 is pivoted on the edge of the envelope 4 by a film hinge 17 (FIG. 2) molded integrally with the cap 1. Similarly, the pivot axis 10 between the portion 12 and the lid 9 is embodied with the aid of a film hinge 18 molded integrally with the entire cap 1.

Figure 4:
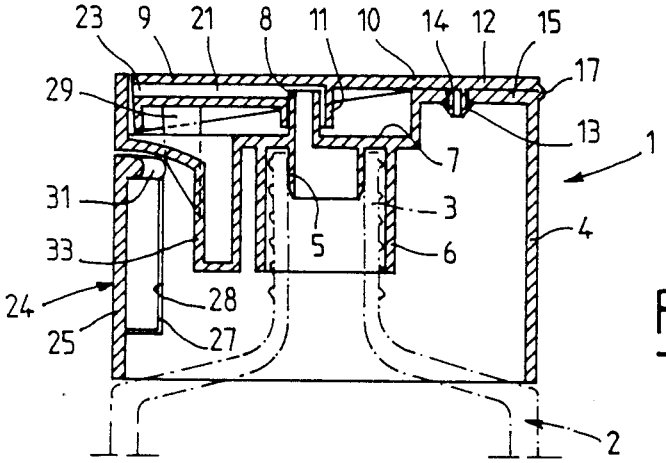
FIG. 4 is a section similar to FIG. 2 through the cap, with the lid in the closed position.

When the lid 9 is folded down into its closed position, shown in FIG. 4, it also enters inside the extension 16 of the envelope 4. Dog points 19 (FIGS. 2 and 3) may be provided on the inside of each of the long sides of the envelope 4 in such a way as to lock into corresponding recesses 20 provided at the edge of the lid 9 in order to hold the lid in the closed position. As a variant, the recesses 20 may have dimensions sufficiently large to remain engaged with the dog points 19 in the open position of the lid and to limit the pivoting travel of this lid. Passageway means including a conduit 21 provided in the lid 9 make it possible to dispense the product from the container 2 to the outside. The conduit 21 is provided with a kind of rib 22 (FIG. 3) projecting below the lid and extending between the sleeve tube 11 and the end of the lid opposite the axis 10. The conduit 21 is parallel to the longitudinal edges of the lid 9 and to the long sides of the envelope 4. The conduit 21 discharges into the sleeve tube 11 and at its opposite end 23 discharges to the outside.

In the closed position of the lid 9, shown in FIG. 4, the end 23 of the conduit 21 is closed by the inside concave surface of the wall of the cap 1.

Figure 5:
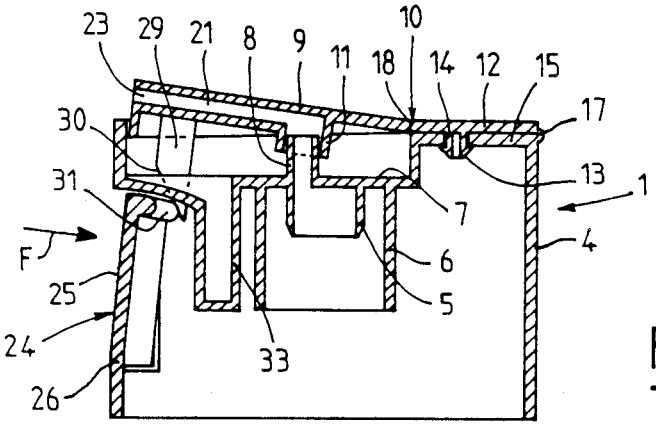
FIG. 5 is a section similar to FIG. 4, showing the lid in the open position.
Figure 6:
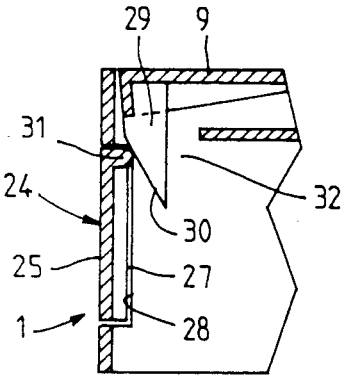
FIG. 6 is a fragmentary section along the line VI-VI of FIG. 3.

Means for opening the cap are provided and include a pushbutton 24 arranged to cause the lid 9 to pivot about its axis, from the closed position shown in FIG. 4 to the opened position of FIG. 5.

This pushbutton 24 is provided in the wall of the envelope 4 on the short convex side of the envelope opposite the side on which the film hinge 17 is provided. The pushbutton 24 is formed by a tongue 25 (FIG. 1), the base of which is attached to the wall of the cap 1 and the other sides of which are free; there is an interstice 27 between the edges of the tongue 25 and the contour of the opening 28 provided in the envelope 4 to receive the tongue 25. As can be seen in FIG. 1, the portion 26 serving to attach the tongue 25 has a width along a direction orthogonal to the generatrices of the envelope 4 that is clearly less than that of the tongue 25. The flexibility of the material at the base 26 assures the pivoting of the tongue 25.

Toward its end remote from the axis 10, the lid 9 has on each side an extension 29 that is orthogonal to the lid 9 and provided with an inclined ramp 30, with which the tongue 25 is intended to cooperate; to this end, the tongue is provided with an inside bead 31 in its upper portion.

Each extension 29 is received in a seat 32 provided in the cap, and the pushbutton 24 can engage this seat, in particular via its upper bead 31. An inside wall 33 that forms a kind of well is provided in the envelope 4 to separate the seats 32 and to serve as a guide for the extensions 29. This wall 33 is connected to the horizontal top 7.

Figure 2:
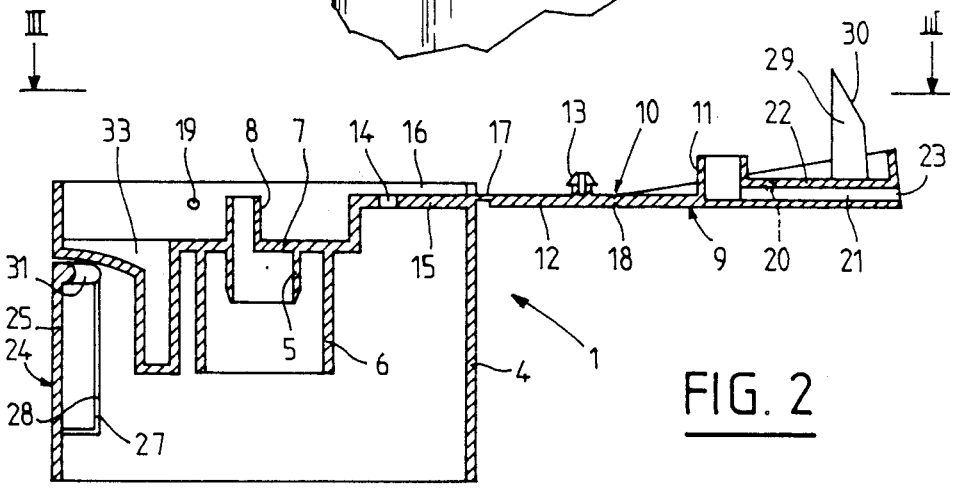
FIG. 2 is a section along the median longitudinal plane of the dispenser cap in its position of molding for manufacture.
Figure 3:
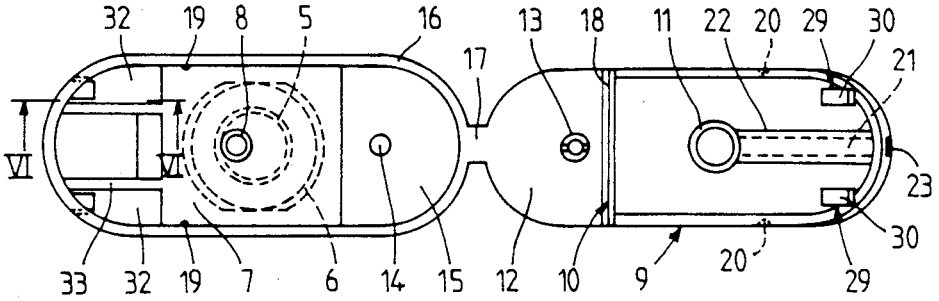
FIG. 3 is a view along the line III-III of FIG. 2.

The entire cap 1 may be made in one piece, by molding from plastic, in the position shown in FIG. 2, which enables particularly economical production.

The use and function of the cap will be readily apparent from the foregoing description.

The cap is put in place on the neck 3 of a container by pressing the short tube 5 into the neck.

When the lid 9 is folded down into the closed position shown in FIG. 4, the nozzle 8 is closed by the inside face of the lid.

When the user desires to dispense the product contained by the container 2, he need merely take the container in one hand and press the pushbutton 24, for example with his thumb, as shown in FIG. 5. The arrow F of this FIG. 5 schematically represents the force exerted upon the pushbutton 24. The pushbutton is pressed toward the inside of the envelope 4 and acts upon the inclined ramp 30, causing the lifting of the lid 9, which pivots about the axis 10.

The amplitude of the pivoting motion, dictated by the pushbutton 24, is provided such that the end 23 of the conduit 21 is disengaged from the cylindrical wall of the envelope 4. In the example described, the angular amplitude of the motion is on the order of 15½ to 20½.

In the open position of the lid 9, shown in FIG. 5, the nozzle 8 remains engaged in the sleeve tube 11.

The user now need merely incline the container 2, and optionally press on the long sides of the container, to cause the product to drain to the outside through the short tube 5, the nozzle 8 and the conduit 21.

After use, the cap is re-closed by pushing downward on the lid 9, to put it into the position shown in FIG. 4, the pushbutton 24 of course having been released.

Figure 7:
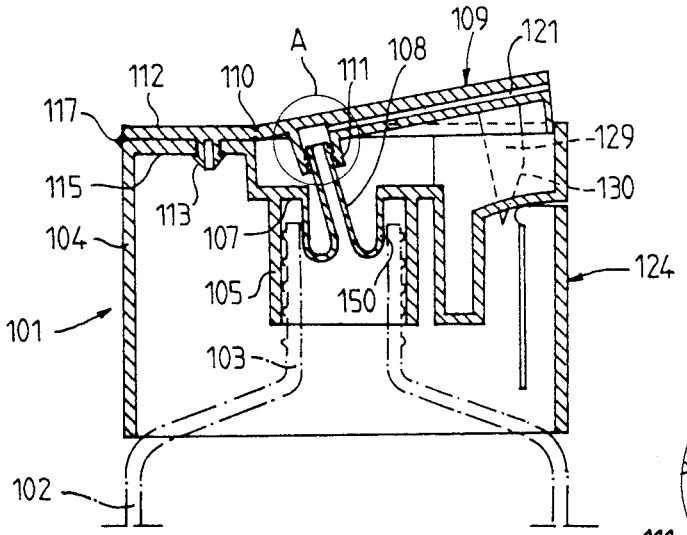
FIG. 7, for a variant embodiment in which the base of the nozzle is deformable, is a section similar to that of FIG. 5.
Figure 7A:
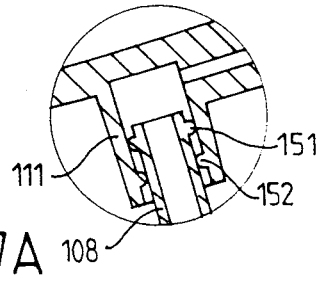
FIG. 7*a* shows the detail A of FIG. 7.

Now turning to FIGS. 7 and 7*a*, it can be seen that a second embodiment of the cap according to the invention is shown. This embodiment differs from the previous one only in the structure of the nozzle and of the sleeve tube with which the nozzle cooperates. In this embodiment, elements corresponding to those of the first embodiment are identified by the same reference numerals, raised by 100. As before, the cap 101 has the same shape as the container, for which it comprises a kind of extension; it is mounted on the neck 103 of the container 102. Inside its outer envelope 104, the cap 101 includes a short tube 105 engaged in a sealed manner on the outside of the neck 103. The short tube 105 comprises a cylinder of revolution having the same axis as the envelope 104 of the cap 101; it is closed by a horizontal top 107 that is orthogonal to the direction of the generatrices of the short tube 105. In its central zone, this top 107 includes a fingerlike protrusion 150 comprising a thin wall that extends parallel to the short tube 105, the lower portion of which finger extends in the direction of the tranverse top 107 via a nozzle 108. Accordingly, the nozzle 108 is connected to the top 107 by a flexible zone and can thus assume an inclination with respect to the axis of the short tube 105 without difficulty.

Means for closing the short tube 105 are provided and include a lid 109 mounted to pivot about an axis 110 substantially orthogonal to that of the short tube 105. On its inside face, this lid 109 includes a sleeve tube 111, having an axis orthogonal to the lid and arranged to cover the nozzle 108, as shown in FIG. 7. On the outside, in the vicinity of its free end, the nozzle 108 includes an annular bead 151, the maximum diameter of which is substantially equivalent to the inside diameter of the sleeve tube 111. In the vicinity of its free end, the inside wall of the sleeve tube 111 includes an annular bead 152, the inside diameter of which is substantially equivalent to that of the outside wall of the nozzle 108. In this manner, the beads 151 and 152 comprise sliding guides for the displacement of the nozzle 108 to the inside of the sleeve tube 111; furthermore, the presence of the beads 151 and 152 prevents disengagement of the nozzle 108 with respect to the sleeve tube 111 in the course of their function. This arrangement makes for more flexible function of the cap according to the invention, since the nozzle 108 is capable of inclining with respect to the axis of the cap and can slide in the sleeve tube 111 with little friction.

The lid 109 is pivoted on the edge on a portion 112 which on its inside face is provided with a barb 113, orthogonal to the portion 112 and arranged to be locked in the upper horizontal wall 115 of the cap 101. The portion 112 is pivoted on the edge of the envelope 104 by a film hinge 117 integral in material with the cap 101. Similarly, the pivot axis 110 between the portion 112 of the lid 109 is attained with the aid of a film hinge that is integral in material with the entire cap 101.

The lid 109 includes a conduit 121 making it possible to dispense the product from the container to the outside. When the lid 109 is in the closed position, the nozzle 108 is closed by the inside face of the lid. Contrarily, in the open position, the nozzle 108 communicates with the conduit 121, and the end of the conduit 121 opposite the sleeve tube 111 is disengaged.

This embodiment will not be described in further detail, since for the other elements that it includes, reference need merely be made to the first exemplary embodiment described above.

Figure 8:
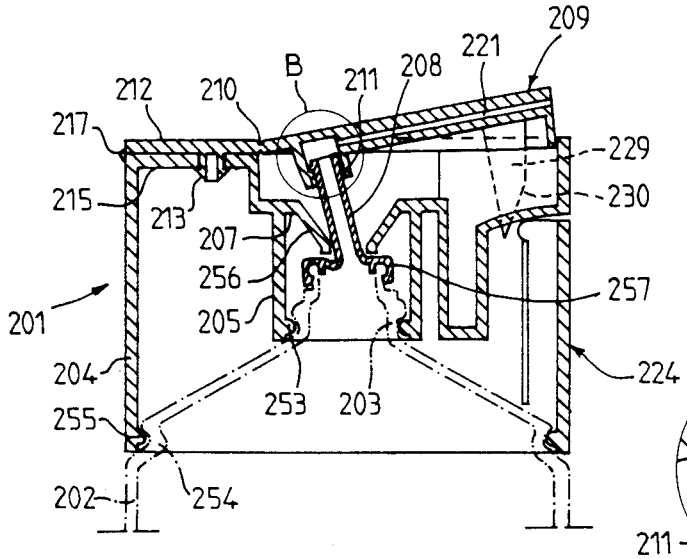
FIG. 8, for another variant embodiment in which the nozzle is a deformable part independent of the cap per se, in a section similar to that of FIG. 7.
Figure 8A:
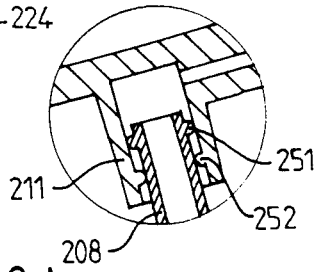
FIG. 8*a* shows the detail B of FIG. 8.

In a third embodiment of the invention, shown in FIGS. 8 and 8*a*, a nozzle has been provided comprising a part separate from the cap itself. For this embodiment, elements similar to those of the first exemplary embodiment are identified by the same reference numerals, raised by 200.

The cap 201 is intended to be mounted on the neck 203 of a container 202. It includes an outer envelope 204, the base of which is locked by a locking bead 255 on a locking throat 254 made in the wall of the container 202. Inside the envelope 204, the cap according to the invention includes a short tube 205, which comprises a cylinder of revolution arranged to come to cover the outside of the neck 203 of the container 202.

The short tube 205 has the same axis as the envelope 204 and is closed by a horizontal top 207 that is orthogonal to the direction of its generatrices. The central zone of this top 207 includes a conical depression 256 oriented toward the neck 203 of the container 202. A nozzle 208 is fixed onto the free end of the neck 203, with its base 257 locked on the neck 203. The nozzle 208 is made of a flexible deformable material and consequently is capable of assuming inclined positions with respect to the axis of the neck 203, or in other words with respect to the base 257 of the nozzle.

Means for closing the nozzle 208 are provided and include a lid 209 mounted to pivot about an axis 210 substantially orthogonal to that of the short tube 205. In the folded-down closed position, the lid 209 is arranged to close the nozzle 208. This lid 209 includes a sleeve tube 211 on its inside face that has an axis orthogonal to the lid and is arranged to cover the nozzle 208. The lid 209 is pivoted on the edge of a portion 212, which on its inside face is provided with a barb 213 that is orthogonal to the portion 212 and arranged to be locked in a hole provided on an upper horizontal wall 215 of the cap 201. The portion 212 is articulated on the edge of the envelope 204 by a film hinge 217 that is integral in material with the cap 201. Similarly, the pivot 210 between the portion 212 and the lid 209 is attained with the aid of a film hinge that is integral in material with the entire cap 201.

When the lid 209, in response to the action of the pushbutton 224, moves from the closed position to the open position as shown in FIG. 8, the bore 208 assumes an inclined position with respect to the axis of the container 202, and its free end slides inside the sleeve tube 211. As in the second exemplary embodiments described above, the ends of the bore 208 and of the sleeve tube 211 include beads 251 and 252 which comprise sliding guides for the displacement of the nozzle 208 to the inside of the sleeve tube 211 and also act as a safety device, to prevent disengagement of the nozzle 208 from the sleeve tube 211.

In the embodiment described, it has also been provided that the short tube 205 locks to the base of the neck 203 via a locking bead 253.

The other elements of the third exemplary embodiment will not be described in further detail, since they are identical to those described for the first exemplary embodiment.

What is claimed is:

1. A cap for dispensing a fluid or viscous product, intended for being mounted on the neck of a container containing the product, the cap including a wall and a short tube for engaging the neck and being supported by a horizontal top associated with a nozzle projecting from a side of the top opposite the short tube, the nozzle communicating with the interior of the container, the cap also including passageway means for dispensing the product to the outside and means for closing and opening said passageway means, said opening means including a lid in the form of a small plate mounted pivotably about an axis substantially orthogonal to that of the short tube, the lid being arranged to move to a closed position to close the nozzle, the passageway means including a conduit provided in the lid and discharging to the outside of said lid, said conduit communicating with the nozzle, characterized in that the opening means include a pushbutton arranged to cause the lid to pivot about its axis from the closed position to an open position; said pushbutton being provided in the wall of said cap, said pushbutton being movable between actuated and deactuated positions and said lid extending generally in a plane and having an underside beneath said conduit with ram means provided on said underside extending away from said conduit positioned to cooperate with said pushbutton so that, when said pushbutton is moved from said deactuated to said actuated positions, said pushbutton will engage said ramp means to move said ramp means and thereby said lid to an opened position, said pushbutton being independent of said lid.

2. A cap as defined by claim 1, characterized in that the nozzle is disposed on the horizontal top of the short tube.

3. A cap as defined by claim 1, characterized in that the nozzle is disposed on the neck of the container and extends through the horizontal top.

4. A cap as defined by claim 1, characterized in that the pushbutton is formed by a tongue, the base of which is contiguous with the wall of the cop and the other sides of which are free, the flexibility of the material at the base permitting the pivoting of the tongue, the end of which opposite the base is intended to cooperate with the ramp.

5. A cap as defined by claim 1, characterized in that the lid is provided with a sleeve tube arranged to cover the nozzle, the conduit of the lid discharging in the sleeve tube, said nozzle remaining engaged in the sleeve tube when the lid is occupying the open position.

6. A cap as defined by claim 5, characterized in that the nozzle and the horizontal top are substantially rigid, and that the inside diameter of the sleeve tube is greater than the outside diameter of the nozzle, in order to provide a play that permits the deflection of the lid between an open position and its closed position.

7. A cap as defined by one of the claims 1, 2 or 3, characterized in that the lid, in the closed position, fits inside the contour of the envelope of the cap, the end of the conduit provided in the lid discharging horizontally, in use, to the outside and being closed by the inside surface of the wall of the cap when the lid is in the closed position.

8. A container for a fluid or viscous product including a neck, characterized in that said neck is equipped with a cap as defined by one of the claims 1, 2 or 3.

9. The cap as claimed in claim 1 wherein said lid includes opposite side edges and an extension member extending from each side edge with each said extension member terminating in a ramp, said cap having a pair of seats each for receiving a said extension member when said lid is in the closed position, said pushbutton being positioned to engage said ramps when said extension members are disposed in said respective seats.

* * * * *